US009697758B2

(12) United States Patent
Watanabe et al.

(10) Patent No.: US 9,697,758 B2
(45) Date of Patent: Jul. 4, 2017

(54) CONTROL DEVICE, DISPLAY DEVICE, AND DISPLAY DEVICE CONTROL METHOD

(71) Applicant: Sharp Kabushiki Kaisha, Osaka-shi, Osaka (JP)

(72) Inventors: Tatsuo Watanabe, Osaka (JP); Kenji Maeda, Osaka (JP); Tadashi Aoki, Osaka (JP); Daisuke Koyama, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 15 days.

(21) Appl. No.: 14/442,798

(22) PCT Filed: Oct. 30, 2013

(86) PCT No.: PCT/JP2013/079442
§ 371 (c)(1),
(2) Date: May 14, 2015

(87) PCT Pub. No.: WO2014/080731
PCT Pub. Date: May 30, 2014

(65) Prior Publication Data

US 2015/0287352 A1 Oct. 8, 2015

(30) Foreign Application Priority Data

Nov. 20, 2012 (JP) ..... 2012-254547

(51) Int. Cl.
*G09G 3/20* (2006.01)
*G09G 3/36* (2006.01)

(52) U.S. Cl.
CPC ..... *G09G 3/20* (2013.01); *G09G 3/3648* (2013.01); *G09G 2300/043* (2013.01);
(Continued)

(58) Field of Classification Search
CPC .... G09G 3/2011; G09G 3/2025; G09G 3/204; G09G 3/2044; G09G 3/2096; G09G 3/30
See application file for complete search history.

(56) References Cited

U.S. PATENT DOCUMENTS

2003/0020699 A1 1/2003 Nakatani et al.
2003/0122773 A1 7/2003 Washio et al.
(Continued)

FOREIGN PATENT DOCUMENTS

JP 2003-044011 A 2/2003
JP 2003-076337 A 3/2003
(Continued)

OTHER PUBLICATIONS

Official Communication issued in International Patent Application No. PCT/JP2013/079442, mailed on Dec. 10, 2013.

*Primary Examiner* — Olga Merkoulova
(74) *Attorney, Agent, or Firm* — Keating & Bennett, LLP

(57) ABSTRACT

A display device that suppresses electric power consumption and displays an image with excellent quality is to be realized. A host control section (30) in accordance with an aspect of the present invention is a control device for a display device (1), said control device includes: an image determining section (35) for determining whether or not grayscale levels of a plurality of pixels in an image fall within a first range which consists of intermediate grayscale levels; and a driving changing section (36) for changing, according to a result of the determining carried out by the image determining section (35), a refresh rate of the display device (1).

8 Claims, 10 Drawing Sheets

(52) U.S. Cl.
CPC ..... *G09G 2320/0247* (2013.01); *G09G 2320/103* (2013.01); *G09G 2330/021* (2013.01); *G09G 2340/0435* (2013.01); *G09G 2360/16* (2013.01)

(56) References Cited

U.S. PATENT DOCUMENTS

| | | | | |
|---|---|---|---|---|
| 2009/0251445 | A1 | 10/2009 | Ito et al. | |
| 2009/0295786 | A1 | 12/2009 | Ito et al. | |
| 2010/0085477 | A1 | 4/2010 | Ooishi et al. | |
| 2010/0128054 | A1 | 5/2010 | Manabe | |
| 2010/0156886 | A1 | 6/2010 | Kawabe | |
| 2011/0199404 | A1 | 8/2011 | Umezaki et al. | |
| 2011/0205254 | A1* | 8/2011 | Umezaki ..... | G09G 3/3648 345/690 |
| 2012/0169785 | A1* | 7/2012 | Kawabe ..... | G09G 3/2022 345/690 |
| 2012/0169954 | A1* | 7/2012 | Liu ..... | G09G 3/3611 349/38 |

FOREIGN PATENT DOCUMENTS

| | | | |
|---|---|---|---|
| JP | 2003-248468 | A | 9/2003 |
| JP | 2009-251607 | A | 10/2009 |
| JP | 2009-288789 | A | 12/2009 |
| JP | 2010-085946 | A | 4/2010 |
| JP | 2010-122609 | A | 6/2010 |
| JP | 2010-276980 | A | 12/2010 |
| JP | 2011-186449 | A | 9/2011 |
| JP | 2011-191746 | A | 9/2011 |

* cited by examiner (a)

(b)

| | |
|---|---|
| CONDITION 1 | PERCENTAGE OF PIXELS HAVING GRAYSCALE LEVELS IN RANGE OF 20 TO 80 IS 30% OR HIGHER |
| CONDITION 2 | PERCENTAGE OF PIXELS HAVING GRAYSCALE LEVELS IN RANGE OF 10 TO 160 IS 20% OR HIGHER |
| CONDITION 3 | PERCENTAGE OF PIXELS HAVING GRAYSCALE LEVELS IN RANGE OF 40 TO 60 IS 40% OR HIGHER |
| CONDITION 4 | PERCENTAGE OF PIXELS HAVING GRAYSCALE LEVELS IN RANGE OF 20 TO 80 IS 30% OR HIGHER |

(a)

(b)

| | |
|---|---|
| CONDITION 5 | PERCENTAGE OF PIXELS HAVING GRAYSCALE LEVELS IN RANGE OF 20 TO 40 IS 15% OR HIGHER |
| CONDITION 6 | PERCENTAGE OF PIXELS HAVING GRAYSCALE LEVELS IN RANGE OF 41 TO 80 IS 15% OR HIGHER |

CONTROL DEVICE, DISPLAY DEVICE, AND DISPLAY DEVICE CONTROL METHOD

TECHNICAL FIELD

The present invention relates to a control device, a display device, and a method of controlling the display device.

BACKGROUND ART

In recent years, thin, light, and low-power-consumption display devices such as liquid crystal display devices have been remarkably widespread. Typical examples of apparatuses on which to mount such display devices encompass mobile phones, smartphones, notebook-sized PCs (Personal Computers). It is expected that in the future, development and prevalence of electronic paper, which is an even thinner display device, will be rapidly advanced. Under such circumstances, it is a common challenge to reduce power consumption of display devices.

According to conventional CG (Continuous Grain) silicon TFT liquid crystal display panels, amorphous silicon TFT liquid crystal display panels, and the like, it is necessary to refresh a screen at 60 Hz. Therefore, for a reduction in electronic power consumption of the conventional liquid crystal display panels, attempts have been made to achieve a refresh rate lower than 60 Hz.

Patent Literature 1 discloses a liquid crystal display configured such that in a case where no stripes are present in an image over a series of frames, the liquid crystal display device (i) determines that the frames have no characteristic that easily induces flicker and then (ii) lowers a refresh rate.

CITATION LIST

Patent Literature 1

Japanese Patent Application Publication, Tokukai, No. 2009-251607 (Publication Date: Oct. 29, 2009)

Patent Literature 2

Japanese Patent Application Publication, Tokukai, No. 2003-76337 (Publication Date: Mar. 14, 2003)

Patent Literature 3

Japanese Patent Application Publication, Tokukai, No. 2009-288789 (Publication Date: Dec. 10, 2009)

Patent Literature 4

Japanese Patent Application Publication, Tokukai, No. 2011-186449 (Publication Date: Sep. 22, 2011)

Patent Literature 5

Japanese Patent Application Publication, Tokukai, No. 2003-44011 (Publication Date: Feb. 14, 2003)

SUMMARY OF INVENTION

Technical Problem

However, with liquid crystal display panels employing CG silicon TFTs or amorphous silicon TFTs, it is only possible to lower a refresh rate to 50 Hz at best while maintaining display quality.

In recent years, diligent attempts have been made to develop an oxide semiconductor liquid crystal display panel in which TFTs are each constituted by an oxide semiconductor that uses indium (In), gallium (Ga), and zinc (Zn). According to a TFT constituted by an oxide semiconductor, only a small amount of electric current leaks in an off state. Therefore, unlike the cases of conventional liquid crystal panels, it is unnecessary for an oxide semiconductor liquid crystal display panel to refresh a screen at 60 Hz, and it is therefore possible to lower a refresh rate to approximately 1 Hz. This allows for a reduction in electric power consumption.

However, in a case where response speed of liquid crystals is slow, driving a display device at a low refresh rate poses a problem of causing flicker to be easily recognized due to non-uniform pixel capacitances or the like. Since slow response speed of liquid crystals causes an alignment status of liquid crystals to change over a period in which a screen is not refreshed, changes in grayscale levels can be easily recognized. In addition, electric charge leaks from pixels via TFTs in an off state. Therefore, in a case where pixel capacitance is not uniform, a change in pixel potential differs from pixel to pixel. These problems are not addressed by Patent Literature 1. Although Patent Literature 2 through 4 also disclose techniques for setting a refresh rate of a liquid crystal display panel, none of the them addresses the problems.

According to an aspect of the present invention, it is possible to realize a display device capable of suppressing electric power consumption as well as displaying an image with excellent quality.

Solution to Problem

A control device in accordance with an aspect of the present invention is a control device for a display device, said control device including: an image determining section for determining whether or not grayscale levels of a plurality of pixels in an image fall within a first range which consists of intermediate grayscale levels; and a driving changing section for changing, according to a result of the determining carried out by the image determining section, a refresh rate of the display device.

A control method in accordance with an aspect of the present invention is a method of controlling a display device, including the steps of: (a) determining whether or not grayscale levels of a plurality of pixels in an image fall within a first range which consists of intermediate grayscale levels; and (b) changing, according to a result of the determining carried out in the step (a), a refresh rate of the display device.

Advantageous Effects of Invention

According to an aspect of the present invention, it is determined whether or not grayscale levels of respective of a plurality of pixels in an image fall within a first range. This makes it possible to determine whether or not flicker is easily recognizable in the image. According to a determined result, a refresh rate of a display device is changed. This allows for a reduction in electric power consumption and makes it possible to display an image while preventing flicker from being recognized.

DESCRIPTION OF EMBODIMENTS

Embodiment 1

Figure 2:
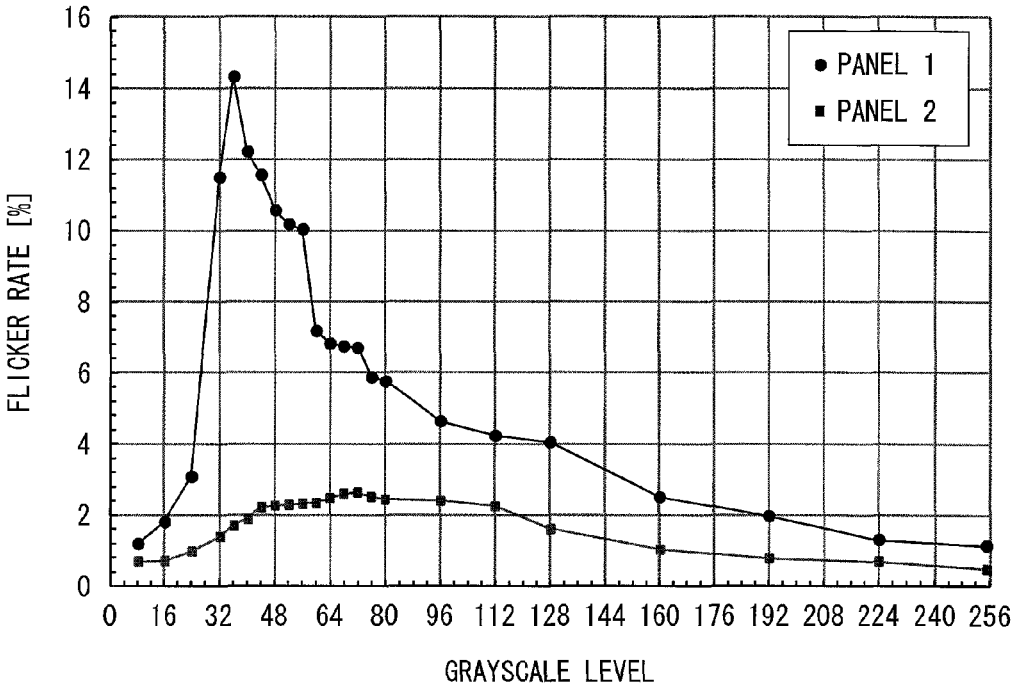
FIG. 2 is a graph showing flicker rates corresponding to respective grayscales levels at which an oxide semiconductor liquid crystal display panel is driven with a refresh rate of 1 Hz.

FIG. 2 is a graph showing flicker rates corresponding to respective grayscales levels at which an oxide semiconductor liquid crystal display panel is driven with a refresh rate of 1 Hz. A flicker rate indicates a degree to which flicker is recognizable, and a larger value of the flicker rate means greater recognizability of the flicker. A flicker rate of 1.5%, for example, is one indicator of whether or not flicker can be easily recognized. In a case where the oxide semiconductor liquid crystal display panel is driven at a low refresh rate, it is a grayscale level of an image that determines whether or not flicker easily occurs. In FIG. 2, a minimum grayscale level (black) is 0, whereas a maximum grayscale level (white) is 255. Note that recognizability of flicker also varies, depending on a screen size and production process. A panel 1 is a liquid crystal display panel greater in size than a panel 2. The panel 1 and the panel 2 also differ in production process.

A response speed of liquid crystals at intermediate grayscale levels is relatively slow. In addition, at the intermediate grayscale levels, a change in grayscale level (change in alignment of liquid crystal molecules) as a result of leakage of electric charge via TFTs can easily occur. Note that "intermediate grayscale levels" refer to all grayscale levels except for saturated grayscale levels (i.e. maximum grayscale level and the minimum grayscale level). For example, where the minimum grayscale level and the maximum grayscale level are 0 and 255, respectively, grayscale levels falling within a range of grayscale level 1 to grayscale level 254 are intermediate grayscale levels. In a case of a normally-black type, flicker is more easily recognizable in a range of, for example, grayscale level 10 to grayscale level 200 of all the intermediate grayscale levels. Furthermore, flicker is even more easily recognizable in a range of grayscale level 20 to grayscale level 80, and is particularly easily recognizable in a range of grayscale level 40 to grayscale level 60. For example, in a case where an image including a large number of pixels having grayscale levels of the above described ranges is displayed at a refresh rate of 1 Hz, a screen is refreshed every second. This may cause a user to recognize flicker every second.

Therefore, according to Embodiment 1, recognition of flicker is prevented by driving a display device at an increased refresh rate in a case where an image includes a large number of pixels having grayscale levels of a predetermined range.

(Configuration of Display Device 1)

Figure 1:
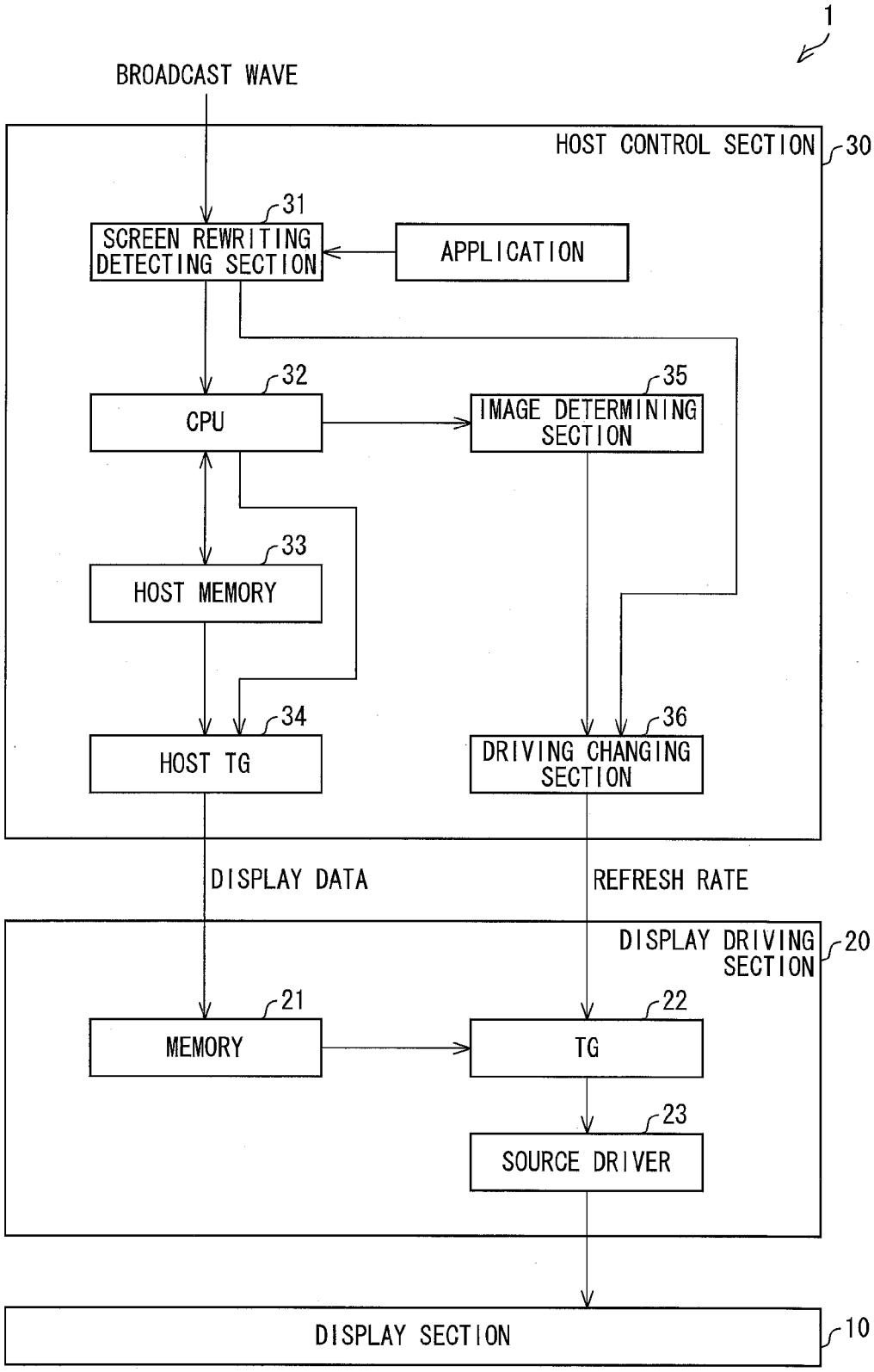
FIG. 1 is a block diagram illustrating a configuration of a display device in accordance with an aspect of the present invention.

FIG. 1 is a block diagram illustrating a configuration of a display device in accordance with an embodiment of the present invention. A display device 1 includes a display section 10, a display driving section 20, and a host control section 30 (control device).

The display section 10 includes a screen, and is constituted by, for example, an oxide semiconductor liquid crystal display panel serving as an active matrix liquid crystal display panel. The oxide semiconductor liquid crystal display panel is a liquid crystal display panel in which the above-described oxide semiconductor-TFT is used as each switching element provided so as to correspond to one or more of a plurality of pixels that are two dimensionally arranged. The oxide semiconductor-TFT is a TFT having a semiconductor layer made of an oxide semiconductor. Examples of the oxide semiconductor encompass an oxide semiconductor (InGaZnO-based oxide semiconductor) in which an oxide of indium, gallium, and zinc is used. According to the oxide semiconductor-TFT, (i) an amount of electric current flowing in an on state is large and (ii) an amount of leak current in an off state is small. Therefore, by using the oxide semiconductor-TFT for a switching element, it is possible to increase a pixel aperture ratio and to reduce a refresh rate of image display to approximately 1 Hz. Reducing the refresh rate allows for such an effect as a reduction in electric power consumption. An increase in a pixel aperture ratio brings about such an effect as causing a displayed image to be brighter. In a case where the brightness of image display is to be set equal to that of a CG silicon liquid crystal display panel or the like, an increased pixel aperture ratio brings about such an effect as reducing electric power consumption by decreasing a light intensity of a backlight. Note also that the present invention is not limited to a display device using an oxide semiconductor-TFT, but is applicable to any display device capable of changing a refresh rate.

(Configuration Host Control Section 30)

The host control section 30 includes a screen rewriting detecting section 31 (rewriting detection section), a CPU 32, a host memory 33, a host TG 34 (host timing generator), an image determining section 35, and a driving changing section 36. The host control section 30 is configured by, for example, a control circuit provided on a substrate.

The screen rewriting detection section 31 evaluates whether or not an image displayed on the screen of the display section 10 needs to be rewritten. For example, the screen rewriting detection section 31 notifies the CPU 32 of necessity to rewrite displaying (image) of the screen in cases such as (i) a case where an application, which was launched and is being run within the display device 1, notifies the screen rewriting detection section 31 that a displayed image needs be rewritten, (ii) a case where a user of the display device 1 notifies, via an input section, notifies the screen rewriting detection section 31 that a displayed image needs to be rewritten, and (iii) a case where the screen rewriting detection section 31 is notified of the necessity to rewrite a displayed image due to data streaming via the Internet, a broadcast wave, or the like.

Note that display data inputted in the screen rewriting detection section 31 includes (i) data on a displayed image to be rewritten in a frame and (ii) a display rewriting flag (time reference) indicative of a timing with which to display the image data. In a case where content of an image is not changed over a plurality of frames, data in frames in which the content of the image is not changed is not included in the display data. Based on the display rewriting flag, the screen rewriting detection section 31 can detect the necessity to rewrite a displayed image. The screen rewriting detection section 31 stores time of a frame at which the content of the image was changed. Then, based on the display rewriting flag, the screen rewriting detection section 31 evaluates an interval between (i) a given frame in which the content of the image was changed (frame in which the displayed image was rewritten) and (ii) a following frame in which the content of the image was changed next. Based on the interval, it is possible to determine whether the displayed image is a moving image or a still image. The screen rewriting detection section 31 supplies the display rewriting flag and the display data to the CPU 32. In addition, the screen rewriting detection section 31 supplies, to the driving changing section 36, data on the interval at which the content of the image is changed.

Note that in a case where the display data does not include a display rewriting flag but includes data on all frames, the screen rewriting detection section 31 can determine, by comparing an image in a given frame and an image in a following frame, whether or not content of the image is changed. Based on a result of the comparison, the screen rewriting detection section 31 can detect necessity to rewrite a displayed image. In such a case also, the screen rewriting detection section 31 evaluates, based on time of frame at which the displayed image is rewritten, an interval between (i) a frame in which the content of the image was changed and (ii) a following frame in which the content of the image was changed next.

The CPU 32 (i) obtains, from the screen rewriting detection section 31, the display data of one entire screen and then (ii) writes the display data into the host memory 33. The CPU 32 also supplies the display data to the image determining section 35. The CPU 32 also supplies the rewriting flag to the host TG 34.

The host memory 33 is a storage device configured by a VRAM (Video Random Access Memory) or the like.

When the host TG 34 receives the rewriting flag from the CPU 32, the host TG 34 (i) obtains the display data from the host memory 33 and (ii) transfers the display data to the display driving section 20. Only in a case where a displayed image needs to be rewritten, the host TG 34 transfers, to the display driving section 20, display data on the image is to be rewritten in a frame. The host TG 34 transfers the display data in accordance with data communication specifications of a mobile device, such as MIPI (Mobile Industry Processor Interface). Note that the host TG 34 transfers, to the display driving section 20, a sync signal along with the display data.

The image determining section 35 determines whether or not an image based on the display data is an image in which flicker easily occurs. Specifically, the image determining section 35 determines whether or not pixels in the image have grayscale levels falling within a range (first range) of grayscale level 20 to grayscale level 80. The image determining section 35 determines a percentage of pixels, of all pixels falling within a predetermined region, which have grayscale levels falling within the first range. Specifically, the image determining section 35 (i) generates a histogram in which pixels of every 10 grayscale levels are categorized into a corresponding one of classes and (ii) determines, based on the histogram, a percentage of pixels having grayscale levels within the first range. Although the predetermined region is herein assumed to be an entire region of the image, the predetermined region can be a partial region of the image. The image determining section 35 determines whether or not the percentage of the pixels having grayscale levels within the first range is equal to or higher than 30% (first threshold value). In a case where the percentage is equal to or higher than 30%, the image determining section 35 determines that flicker easily occurs in the image. In a case where the percentage is lower than 30%, the image determining section 35 determines that flicker does not easily occurs in the image. The image determining section 35 supplies, to the driving changing section 36, a determined result indicative of whether or not the percentage of the pixels having grayscale levels within the first range is equal to or higher than the first threshold value. Values of the first range and the first threshold value are illustrative only, and can be other values.

According to the determined result of the image determining section 35, the driving changing section 36 changes the refresh rate of the display section 10. In a case where (i) the displayed image is a still image and (ii) the percentage of pixels having grayscale levels within the first range is lower than the first threshold value, the driving changing section 36 determines that the display section 10 displays the image at a first refresh rate (1 Hz). In a case where (i) the displayed image is a still image and (ii) the percentage of pixels having grayscale levels within the first range is equal to or higher than the first threshold value, the driving changing section 36 determines that the display section 10 displays the image at a second refresh rate (60 Hz) which is higher than the first refresh rate. Note, however, that in a case where the displayed image is a moving image, the driving changing section 36 determines that the display section 10 displays the image at a third refresh rate (30 Hz) which falls between the first refresh rate and the second refresh rate. In a case where the displayed image is a moving image, the content of the image is changed at short intervals. This causes flicker to be hardly recognizable even in a case where a large number of pixels have grayscale levels within the first range. Therefore, in a case where, for example, a moving image is rewritten at a frequency of 30 Hz, it is unnecessary to refresh the moving image at 60 Hz which is higher than 30 Hz. In a case where, for example, a moving image is rewritten at a frequency of 15 Hz, it is possible to refresh the moving image at 15 Hz or 30 Hz. Note that the driving changing section 36 can determine, based on intervals at which the content of the image is changed, whether the displayed image is a moving image or a still image. The driving changing section 36 instructs the display driving section 20 to drive the display section 10 at a refresh rate thus determined.

(Configuration Display Driving Section 20)

The display driving section 20 is, for example, a so-called COG driver and is mounted on a glass substrate of the display section 10 by use of a COG (Chip on Glass) technique. The display driving section 20 drives the display section 10 to cause the screen to display an image based on display data. The display driving section 20 includes a memory 21, a TG 22 (timing generator), and a source driver 23.

The memory 21 stores the display data transferred from the host control section 30. The memory 21 then retains the display data until the displayed image is rewritten (i.e. retains the display data unless the content of the image is changed).

Based on the refresh rate instructed by the host control section 30, the TG 22 reads out the display data from the memory 21, and supplies the display data to the source driver 23. In addition, the TG 22 generates a timing signal for driving the display section 10 at the refresh rate thus instructed, and supplies the timing signal to the source driver 23. Note that, for generating the timing signal, the TG 22 can utilize the sync signal supplied from the host TG.

In accordance with the timing signal, the source driver 23 writes, into the pixels of the display section 10, respective display voltages corresponding to the display data.

Suitable examples of the display device 1 encompass display devices that place importance particularly on portability, such as mobile phones, smartphones, notebook-sized PCs, tablet devices, e-book readers, and PDAs.

(Display Driving Method)

Figure 3:
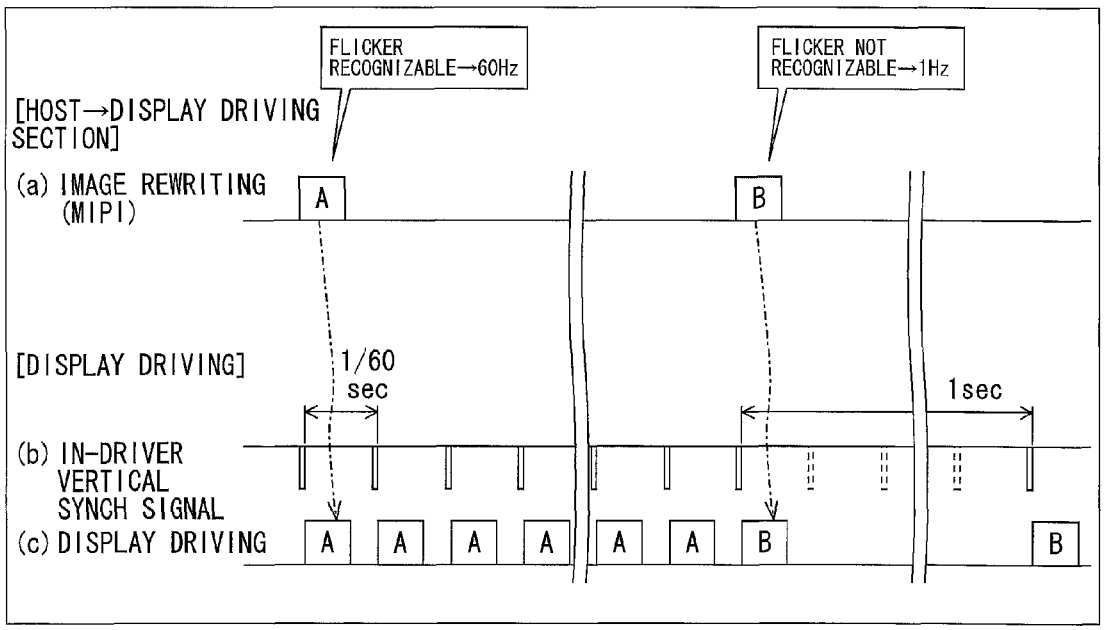
FIG. 3 is a timing chart showing how the display device displays a still image.

FIG. 3 is a timing chart showing how the display device 1 displays a still image. FIG. 3 illustrates a case where a still image A and a still image B are alternately displayed. The image A includes a first threshold value (30%) or a higher percentage of pixels which have grayscale levels falling within a first range (grayscale level 20 to grayscale level 80). This causes flicker to easily occur in the image A. The image B includes less than the first threshold value of pixels which pixels have grayscale levels falling within the first range. This causes flicker to hardly occur in the image B. Therefore, the image A is displayed at a refresh rate of 60 Hz, whereas the image B is displayed at a refresh rate of 1 Hz.

The host control section 30 transfers display data (image A or image B) on one entire screen to the display driving section 20 only when content of a screen is changed (see (a) of FIG. 3). After the display data on the image A is transferred, it is when the displayed image is rewritten to the image B that the host control section 30 transfers display data to the display driving section 20 next.

The display driving section 20 (i) stores the received display data (image A) in the memory 21 and (ii) rewrites, with a timing synchronized with an in-driver vertical synch signal illustrated in (b) of FIG. 3, the displayed image on the display section 10 to the image A (see (c) of FIG. 3). The in-driver vertical synch signal is generated by the TG 22 in accordance with an instructed refresh rate. Note that the description of a delay time between a point in time where the display driving section 20 receives the display data and a point in time where the image is displayed will be omitted. A pulse shown by dotted lines indicates points in time where vertical synch signals are not generated.

Then, the image A thus displayed is refreshed every 1/60 seconds. Specifically, the display driving section 20 operates such that the TG 22 reads out display data (image A) from the memory 21 every 1/60 seconds, and then the source driver 23 supplies the display data to the display section 10.

After the image B is displayed on the display section 10, on the other hand, the image B thus displayed is refreshed every second. Specifically, the display driving section 20 operates such that the TG 22 reads out display data (image B) from the memory 21 every second, and then the source driver 23 supplies the display data to the display section 10. In so doing, an in-driver vertical synch signal is also generated along with the refresh rate of 1 Hz.

Figure 4:
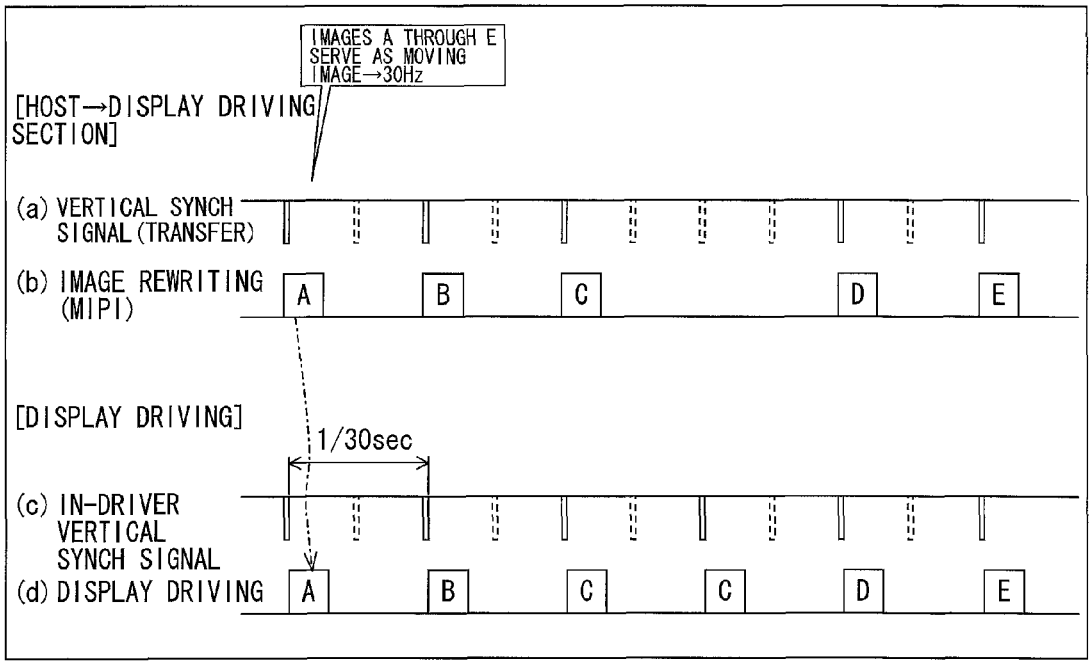
FIG. 4 is a timing chart showing how the display device displays a moving image.

FIG. 4 is a timing chart showing how the display device 1 displays a moving image. FIG. 4 illustrates a case where images A through E, which serve as a moving image, are displayed in turn. The images A, B, D, and E are each displayed for 1/30 seconds, whereas the image C is displayed for 1/15 seconds. Intervals, at which content of the moving images is changed from one image to another, are each equal to or shorter than an interval threshold value (e.g. 400 ms). Therefore, since the images A through E are regarded as a moving image, the images A through E are displayed at a refresh rate of 30 Hz regardless of grayscale levels of the images A through E.

Only when the content of an image is changed, the host control section 30 transfers, with a timing synchronized with a vertical synch signal (transfer), display data (images A through E) of one entire screen to the display driving section 20 (see (a) and (b) of FIG. 4).

The display driving section 20 (i) stores the received display data (image A) in the memory 21 and (ii) rewrites, with a timing synchronized with an in-driver vertical synch signal illustrated in (c) of FIG. 4, the displayed image on the display section 10 to the image A (see (d) of FIG. 4). The in-driver vertical synch signal is generated by the TG 22 in accordance with an instructed refresh rate.

In a case where, as is the case of the image C, intervals at which content of an image is changed are each longer than each of intervals at which an image is refreshed (1/30 seconds), the display driving section 20 operates such that display data (image C) stored in the memory 21 is read out by the TG 22 every 1/30 seconds, and then the source driver 23 supplies the display data to the display section 10.

(Flow 1 of Process of Determining Refresh Rate)

Figure 5:
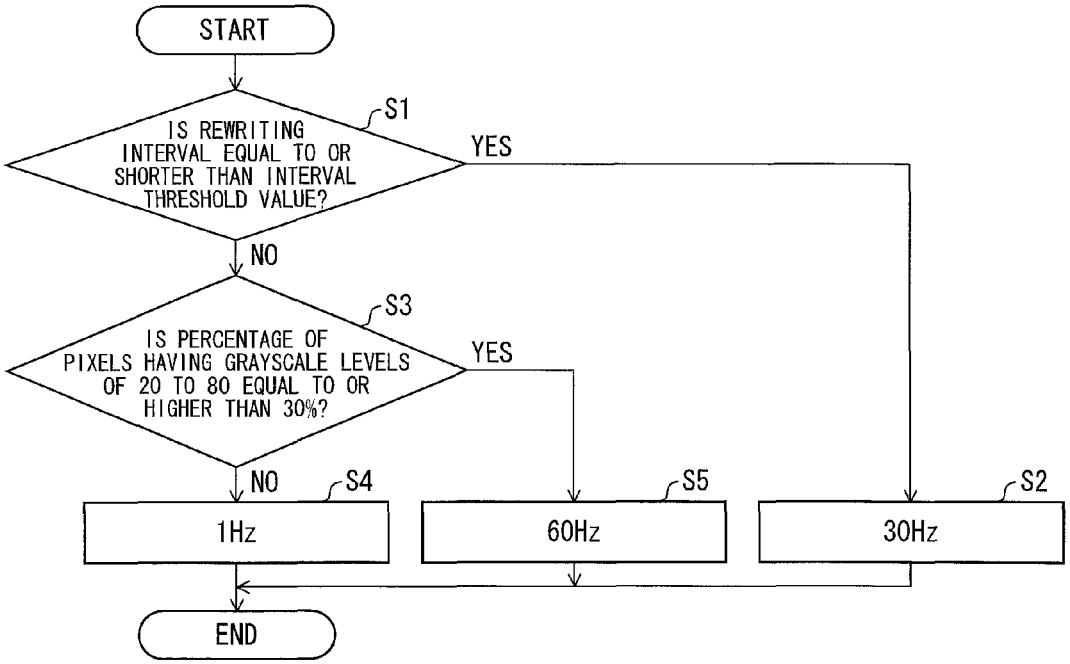
FIG. 5 is a view showing a flow chart of a process in which a host control section of the display device determines a refresh rate.

FIG. 5 is a view showing a flow chart of a process in which the host control section 30 determines a refresh rate. The flow illustrated in FIG. 5 is carried out each time the screen rewriting detection section 31 detects rewriting of a displayed image (i.e. detects a change in content of the image).

When the screen rewriting detection section 31 detects, based on a display rewriting flag or the like, a change in content of an image, the screen rewriting detection section 31 evaluates an interval between points in time at which the content of the image is changed. Then, the driving changing section 36 determines whether or not the interval (rewriting interval) is equal to or shorter than a predetermined interval threshold value (e.g. 400 ms) (S1).

In a case where the interval between points in time at which the content of the image is changed is equal to or shorter than the interval threshold value (Yes in S1), the driving changing section 36 determines that a displayed image is a moving image, and therefore sets a refresh rate to 30 Hz (S2).

In a case where the interval between points in time at which the content of the image is changed is longer than the interval threshold value (No in S1), the driving changing section 36 determines that the displayed image is a still image. Then, the image determining section 35 determines a percentage of pixels, of all pixels included in the image, which have grayscale levels falling within a first range (range of grayscale level 20 to grayscale level 80). Then, the image determining section 35 determines whether or not the percentage is equal to or higher than a first threshold value (30%) (S3).

In a case where (i) the interval between points in time at which the content of the image is changed is longer than the interval threshold value and (ii) the percentage of the pixels having grayscale levels within the first range is lower than the first threshold value (30%) (No in S3), the driving changing section 36 sets the refresh rate to 1 Hz (S4).

In a case where (i) the intervals between points in time at which the content of the image is changed is longer than the interval threshold value and (ii) the percentage of the pixels having grayscale levels within the first range is equal to or higher than the first threshold value (30%) (Yes in S3), the driving changing section 36 sets the refresh rate to 60 Hz (S5).

(Effect of Display Device 1)

According to the display device 1 of Embodiment 1, a refresh rate is set to a high value in a case where a still image to be displayed is an image in which flicker is easily recognizable. This prevents flicker from being recognized. In a case where a still image to be displayed is an image in which flicker is hardly recognizable, the refresh rate is set to a low value. This allows a reduction in electric power consumption. Therefore, with the display device 1, it is possible to reduce electric power consumption while maintaining high display quality.

In a case where a moving image is to be displayed, flicker is hardly recognizable, regardless of grayscale levels of pixels. In a case where a moving image is displayed, the display device 1 sets the refresh rate to a moderate level. This restricts excessive refreshing, and therefore allows for a reduction in electric power consumption. In so doing, the refresh rate only needs to be at least equal to or higher than a frequency at which the moving image is rewritten.

Alternatively, the display device 1 can be configured such that, regardless of whether a moving image or a still image is displayed, a refresh rate is determined according to a percentage of pixels, of all pixels included in the image, which have grayscale levels falling within a first range. For example, it is possible to set a high refresh rate and a low refresh rate to 60 Hz and 15 Hz, respectively.

According to the display device 1, the display driving section 20 refreshes an image during a period in which the image is not changed. This makes it unnecessary for the host control section 30 to transfer an image to the display driving section 20, and therefore allows the host control section 30 to pause its operation during the period in which the image is not changed. A significant effect of reducing electric power consumption can be obtained as a result of the host control section 30 pausing its operation.

(Modification 1)

A single picture element includes R, G, and B pixels. In the example above, the image determining section 35 determines the percentage of pixels, of all pixels in an image, which have grayscale levels within the first range, regardless of colors of the pixels (color component: RGB).

Alternatively, the image determining section 35 can determine (i) respective percentages of R, G, and B pixels having grayscale levels within a first range and (ii) determine respective weighted values of the percentages. In such a case, the image determining section 35 determines whether or not a sum of the weighted values is equal to or higher than a predetermined threshold value. Degrees to which an ordinary person can recognize R, G, and B colors are said to be in a ratio of 3:6:1. That is, an ordinary person clearly recognizes G (green) pixels. This means that flicker is easily recognizable if a large number of G pixels have grayscale levels within the first range. Therefore, the image determining section 35 determines (i) a percentage Rr of R (red) pixels, of all R pixels in a predetermined region of the image, which have grayscale levels within the first range, (ii) a percentage Rg of G pixels, of all G pixel in the predetermined region, which have grayscale levels within the first range, and (iii) a percentage Rb of B pixels, of all B pixels in the predetermined region, which have grayscale levels within the first range. Then, the image determining section 35 determines, as the sum of the weighted values, a value obtained by $(3\times Rr)+(6\times Rg)+(1\times Rb)$. In a case where the sum is equal to or higher than a predetermined threshold value (e.g. a value obtained by $(3+6+1)\times 30[\%]$), the image determining section 35 can determine that flicker is easily recognizable in the image.

Alternatively, whether or not flicker is easily recognizable in an image can be determined by the image determining section 35, based on luminances Y of respective picture elements determined from R, G, and B grayscale levels. Specifically, the image determining section 35 determines the luminances Y of the respective picture elements where, for example, luminance Y=R grayscale×0.29891+G grayscale×0.58661+B grayscale×0.11448. In a case where a luminance Y of a corresponding one of the picture elements falls within a predetermined range (e.g. 20 to 80), the image determining section 35 can determine that pixels included in the picture element have grayscale levels within the first range. That is, in a case where a first threshold value (30%) or a higher percentage of picture elements have luminances Y falling within the predetermined range, the image is displayed at a high refresh rate (60 Hz) so that flicker is prevented from being recognized. In such a case, since the image determining section 35 only needs to store a histogram indicative of luminances Y of the picture elements, a storage capacity only needs to be approximately ⅓ of a storage capacity required in a case where the image determining section 35 stores a histogram indicative of grayscale levels of the respective pixels.

Embodiment 2

The following description will discuss another embodiment of the present invention. For convenience, members similar in function to those described in the foregoing embodiment will be given the same reference signs, and their description will be omitted. Embodiment 2 is similar to Embodiment 1 in terms of block configuration of a display device, but differs from Embodiment 1 in terms of a flow of a process of determining a refresh rate.

(Flow 2 of Process of Determining Refresh Rate)

Figure 6:
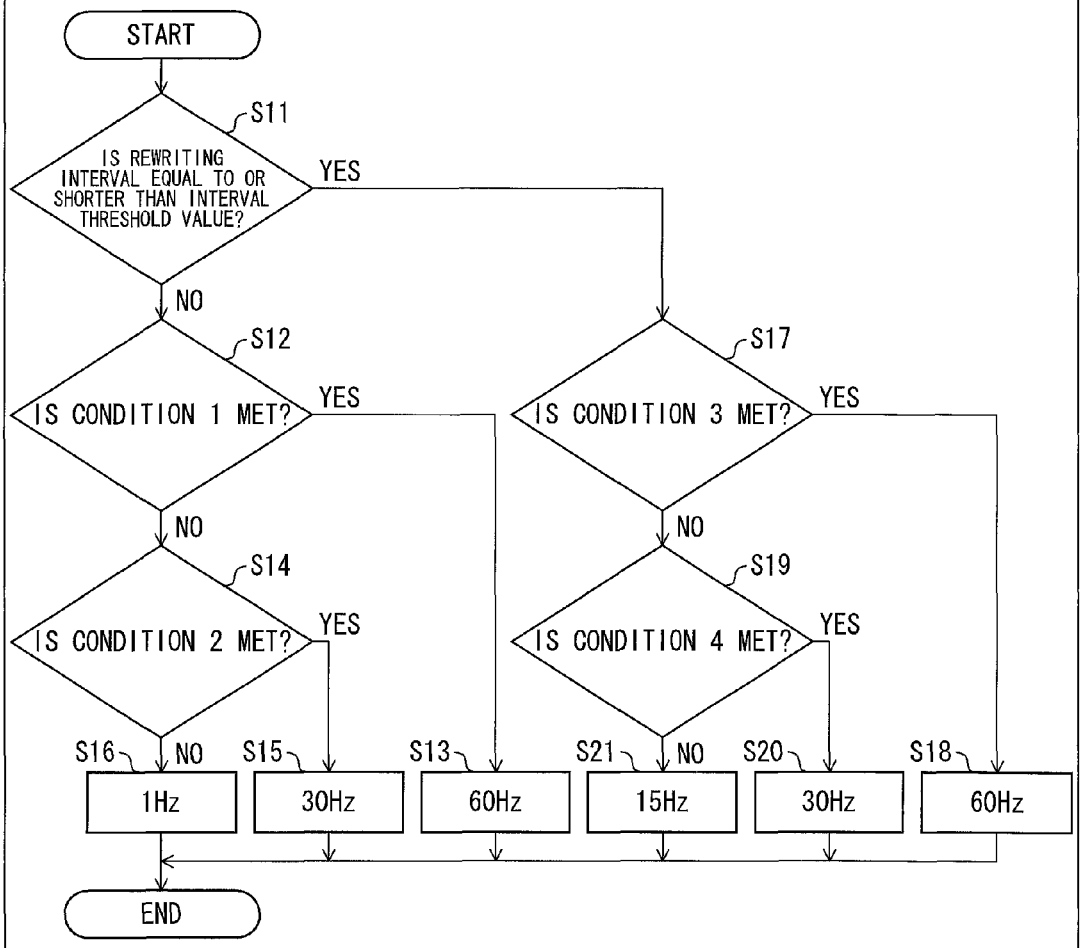
FIG. 6 is a view showing a flow chart of a process in which the host control section determines a refresh rate.

FIG. 6 is a view showing a flow chart of a process in which a host control section 30 of Embodiment 2 determines a refresh rate. The flow illustrated in FIG. 6 is carried out each time a screen rewriting detection section 31 detects rewriting of a displayed image (i.e. detects a change in content of the image).

When the screen rewriting detection section 31 detects, based on a display rewriting flag or the like, a change in content of an image, the screen rewriting detection section 31 evaluates an interval between points in time at which the content of the image is changed. The image determining section 35 generates a histogram in which pixels of an image are categorized according to grayscale levels serving as bins. Then, a driving changing section 36 determines whether or not the interval (rewriting interval) is equal to or shorter than a predetermined interval threshold value (S11).

In a case where the interval between points in time at which the content of the image is changed is longer than the interval threshold value (No in S11), the driving changing section 36 determines that a displayed image is a still image. The image determining section 35 then determines whether or not a condition 1 is met (S12). The condition 1 is that a first threshold value (30%) or a higher percentage of pixels, of all pixels in the image, have grayscale levels falling within a first range (range of grayscale level 20 to grayscale level 80).

In a case where (i) the interval between points in time at which the content of the image is changed is longer than the interval threshold value and (ii) the condition 1 is met (Yes in S12), the driving changing section 36 sets a refresh rate to 60 Hz (S13).

In a case where the interval between points in time at which the content of the image is changed is longer than the interval threshold value and (ii) the condition 1 is not met (No in S12), the image determining section 35 determines whether or not a condition 2 is met (S14). The condition 2 is that a second threshold value (20%) or a higher percentage of pixels, of all the pixels in the image, have grayscale levels falling within a second range (range of grayscale level 10 to grayscale level 160).

In a case where (i) the interval between points in time at which the content of the image is changed is longer than the interval threshold value, (ii) the condition 1 is not met, and (iii) the condition 2 is met (Yes in S14), the driving changing section 36 sets the refresh rate to 30 Hz (S15). The first range is encompassed in and smaller than the second range. Although the pixels having grayscale levels falling within the second range induce flicker less than do the pixels having grayscale levels falling within the first range, there is still a possibility that the pixels having grayscale levels falling within the second range somewhat induce flicker. Therefore, in a case where the condition 2 which is less strict than the condition 1 is met, the image is displayed at a moderate refresh rate so that flicker is prevented from being recognized. This restricts excessive refreshing, and therefore allows for a reduction in electric power consumption.

In a case where (i) the interval between points in time at which the content of the image is changed is longer than the interval threshold value, (ii) the condition 1 is not met, and (iii) the condition 2 is not met (No in S14), the driving changing section 36 sets the refresh rate to 1 Hz (S16). In a case where (i) the condition 1 is not met and (ii) the condition 2 is not met, it is possible to determine that flicker is not to be recognized even if the image is refreshed at a low refresh rate. Therefore, the image is displayed at a low refresh rate, so that electric power consumption is reduced.

In a case where the interval between points in time at which the content of the image is changed is equal to or shorter than the interval threshold value (Yes in S11), the driving changing section 36 determines that an image to be displayed is a moving image. The image determining section 35 then determines whether or not a condition 3 is met (S17). The condition 3 is that a third threshold value (40%) or higher percentage of pixels, of all the pixels included in the image, have grayscale levels falling within a third range (range of grayscale level 40 to grayscale level 60). The third range is encompassed in and smaller than the first range.

In a case where (i) the interval between points in time at which the content of the image is changed is equal to or shorter than the interval threshold value and (ii) the condition 3 is met (Yes in S17), the driving changing section 36 sets the refresh rate to 60 Hz (S18). Even in a case where a moving image is displayed, flicker may be recognizable if a large amount of pixels have such grayscale levels that cause flicker to easily occur. In such a case also, recognition of flicker can be prevented by displaying the image at a high refresh rate.

In a case where (i) the interval between points in time at which the content of the image is changed is equal to or shorter than the interval threshold value and (ii) the condition 3 is not met (No in S17), the image determining section 35 determines whether or not a condition 4 is met (S19). The condition 4 is that a fourth threshold value (30%) or a higher percentage of pixels, of all the pixels included in the image, have grayscale levels falling within a fourth range (range of grayscale level 20 to grayscale level 80).

In a case where (i) the interval between points in time at which the content of the image is changed is equal to or shorter than the interval threshold value, (ii) the condition 3 is not met, and (iii) the condition 4 is met (Yes in S19), the driving changing section 36 sets the refresh rate to 30 Hz (S20). The third range is encompassed in and smaller than the fourth range. Therefore, in a case where the condition 4 which is less strict than the condition 3 is met, the image is displayed at a moderate refresh rate so that flicker is prevented from being recognized.

In a case where (i) the interval between points in time at which the content of the image is changed is equal to or shorter than the interval threshold value, (ii) the condition 3 is not met, and (iii) the condition 4 is not met (No in S19), the driving changing section 36 sets the refresh rate to 15 Hz (S21). In this case, the displayed image is a moving image, the image is displayed at a refresh rate which is low and suitable for displaying a moving image (15 Hz).

In the above described flow 2, the refresh rate is changed in stages according to the percentage of such pixels that cause flicker to easily occur. Therefore, it is possible to reduce excessive refreshing while maintaining higher display quality. Note that the conditions 3 and 4 intended for a moving image are set to be stricter than the conditions 1 and 2, respectively, which are intended for a still image. This is because flicker is harder to recognize in a moving image than is in a still image.

(Flow 3 of Process of Determining Refresh Rate)

Figure 7:
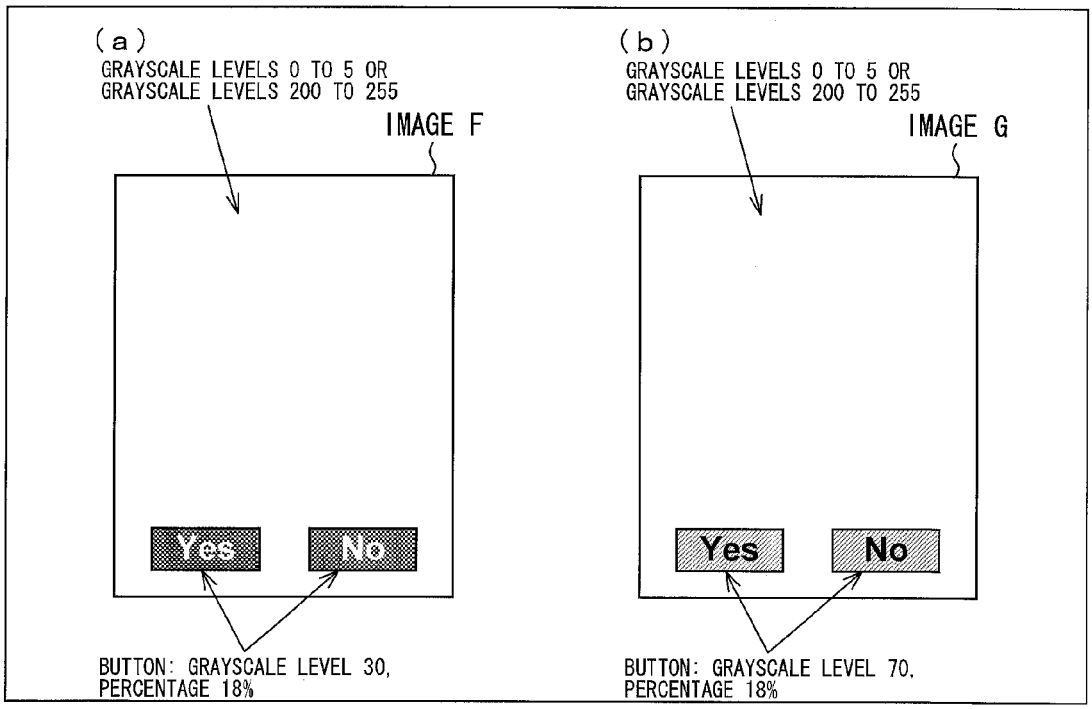
FIG. 7 is a view illustrating images (still images) displayed on a screen of the display device.

(a) and (b) of FIG. 7 are views each illustrating an image (still image) displayed on the screen of the display device 1. On each of images F and G illustrated in (a) and (b) of FIG. 7, respectively, a Yes button and a No button to be selected by a user are provided in front of a white background. In the white background, black color text, for example, is drawn. In the images F and G, button regions have a constant grayscale level of 30 and a constant grayscale level of 70, respectively. In the image F, the button region having a grayscale level of 30 occupies 18% of the entire region. In the image G, the button region having a grayscale level of 70 occupies 18% of the entire region. In other words, in each of the images F and G, 80% or more of the entire region is occupied by a region (background region) which (i) is made up of the white background and black color text and (ii) falls within a grayscale range of grayscale level 0 to grayscale level 5 and a grayscale range of grayscale level 200 to grayscale level 255.

If a refresh rate of each of the images F and G is determined according to the above described flow 1 or 2, then the image is to be displayed at a refresh rate of 1 Hz. However, since the images F and G include the packed regions having grayscale levels of 30 and 70, respectively, displaying each of the images F and G at a low refresh rate may cause flicker to be recognized in the button regions. Nevertheless, if a first threshold value with respect to a first range (range of grayscale level 20 to grayscale level 80) is set to 15%, then a large number of pixels meet this condition, and therefore even an image, in which flicker would not be recognizable at a low refresh rate, ends up being displayed at a refresh rate of 60 Hz. Therefore, in the flow 3 described below, a grayscale range is divided into small segments and then a determining process is carried out.

Figure 8:
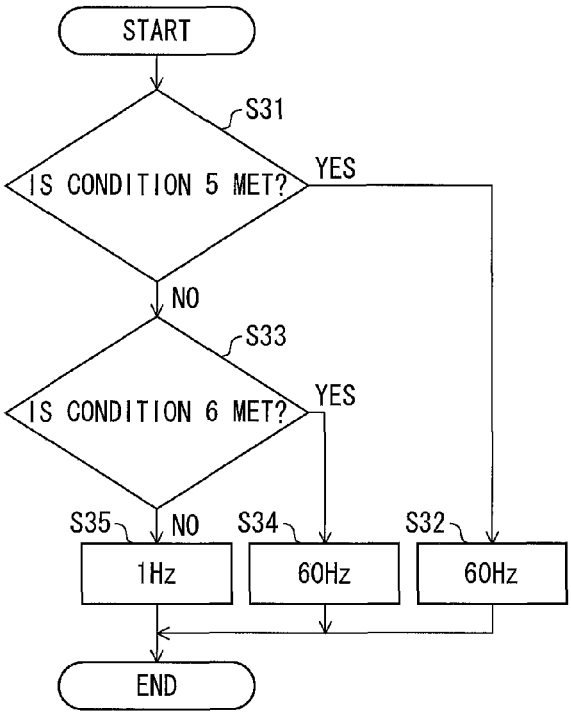
FIG. 8 is a view showing a flow chart of another process in which the host control section determines a refresh rate.

FIG. 8 is a view showing a flow chart of a process in which the host control section 30 determines a refresh rate.

The image determining section 35 determines whether or not a condition 5 is met (S31). The condition 5 is that a fifth threshold value (15%) or a higher percentage of pixels, of all pixels included in an image, have grayscale levels falling within a fifth range (range of grayscale level 20 to grayscale level 40).

In a case where the condition 5 is met (Yes in S31), the driving changing section 36 sets a refresh rate to 60 Hz (S32).

In a case where the condition 5 is not met (No in S31), the image determining section 35 determines whether or not a condition 6 is met (S33). The condition 6 is that a sixth threshold value (15%) or a higher percentage of pixels, of all the pixels included in the image, have grayscale levels falling within a sixth range (range of grayscale level 41 to grayscale level 80).

In a case where (i) the condition 5 is not met and (ii) the condition 6 is met (Yes in S33), the driving changing section 36 sets the refresh rate to 60 Hz (S34).

In a case where (i) the condition 5 is not met and (ii) the condition 6 is not met (No in S33), the driving changing section 36 sets the refresh rate to 1 Hz (S34).

The fifth range and the sixth range cover a continuous range, but do not overlap each other. The fifth threshold value and the sixth threshold value are identical (15%). Intermediate grayscale levels (e.g. in a range of grayscale level 20 to grayscale level 80), in which flicker easily occurs, are thus divided into two ranges, and percentages of pixels falling within the respective ranges are thus determined. This allows an image, such as the images F and G in which flicker is recognizable in small regions, to be displayed at a high refresh rate. Therefore, recognition of flicker can be prevented even in a case of an image including a region, such as a button region, which has such a grayscale level that causes flicker to easily occur. In addition, it is possible to properly identify an image in which flicker does not occur, and to display the image at a low refresh rate.

Note that the fifth range and the sixth range can partially overlap each other, or cover separate ranges. Note also that the fifth threshold value and the sixth threshold value can be different.

Embodiment 3

The following description will discuss another embodiment of the present invention. For convenience, members similar in function to those described in the foregoing embodiment(s) will be given the same reference signs, and their description will be omitted. Embodiment 3 is similar to Embodiment 1 in terms of block configuration of a display device.

(Image Determining Method 1)

In Embodiment 1, what is determined is the percentage of pixels, of all the pixels included in an image, which have grayscale levels falling within a predetermined range. Alternatively, it is possible to determine the percentage of pixels, of all pixels included in part of an image, which have grayscale levels falling within a predetermined range.

Figure 9:
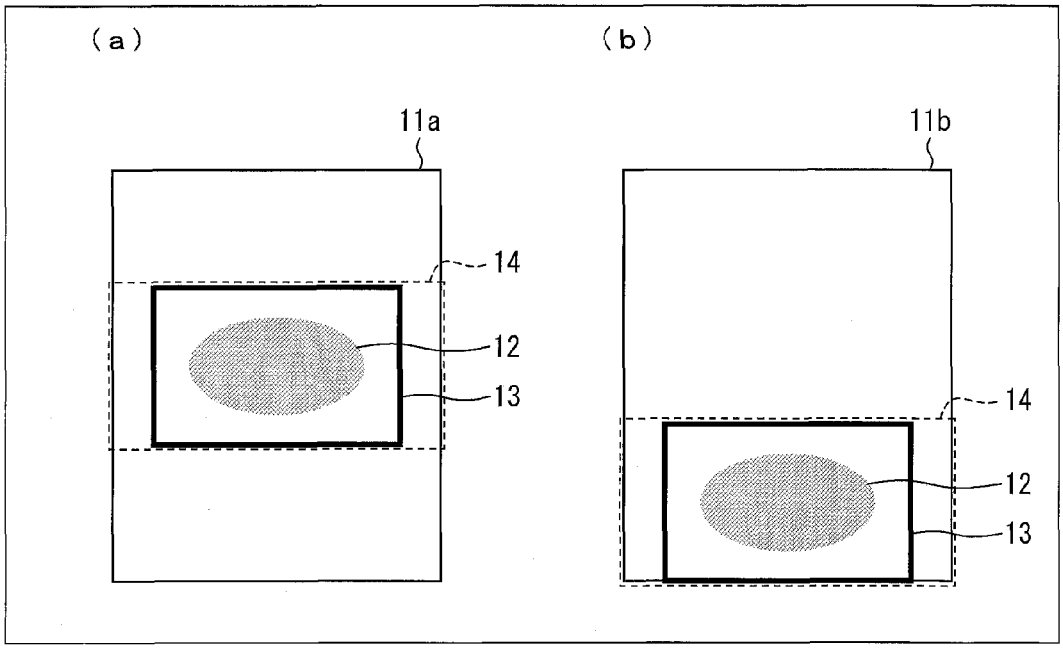
FIG. 9 is a view illustrating screens of the display device.

(a) and (b) of FIG. 9 are views illustrating screens of respective display devices. Uniformity across capacitances of respective pixels depends on a production process. Therefore, a region of a screen of a display device, which region includes pixels having non-uniform capacitances, tends to be concentrated in a certain region. In the example of the display device in (a) of FIG. 9, for example, a region 12, which includes pixels having non-uniform capacitances, is located at a central part of a screen 11*a*. In the example of the display device in (b) of FIG. 9, a region 12, which includes pixels having non-uniform capacitances, is located at a lower part of a screen 11*b*. That is, even in a case where an entire part of a screen displays an image having uniform grayscale levels, (i) flicker in the example shown in (a) of FIG. 9 is easily recognizable at the central part of the screen 11*a* and (ii) flicker in the example shown in (b) of FIG. 9 is easily recognizable in the lower part of the screen 11*b*.

Therefore, it is to be determined whether or not pixels having such grayscale levels that cause flicker to easily occur are distributed throughout a region of the image, which region corresponds to the region 12 including pixels having non-uniform capacitances. This makes it possible to determine whether or not the flicker easily occurs in the image.

According to the display device illustrates in (a) of FIG. 9, an image determining section 35 (region specifying section) specifies, as a predetermined analysis region 13, a partial region located at the central part of the image. According to the display device illustrated in (b) of FIG. 9, an image determining section 35 specifies, as a predetermined analysis region 13, a partial region located at the lower part of the image. Each of the respective analysis regions 13 of (a) and (b) of FIG. 9 includes a region corresponding to the region 12. The image determining section 35 determines whether or not a first threshold value (e.g. 30%) or a higher percentage of pixels, of all the pixels in the analysis region 13, have grayscale levels falling within a first range (e.g. in a range of range of grayscale level 20 to grayscale level 80).

The percentage of pixels having intermediate grayscale levels is thus determined only in a partial region of the image, which partial region corresponds to a region of a screen, which region causes flicker to easily occur. This allows for a reduction in amount of process of determining grayscale levels of pixels. In addition, it is possible to reduce a storage capacity that is required for a histogram.

Assume a case where it is determined that flicker easily occurs in the analysis region 13 of the image (i.e. it is determined that the percentage of pixels having grayscale levels within the first range is equal to or higher than the first threshold value). In such a case, a partial region 14 of each of the screens 11*a* and 11*b*, instead of each of the entire parts of the screens 11*a* and 11*b*, can be driven at a high refresh rate (60 Hz). Note that, according to an active matrix display device, a signal is inputted into pixels of each scan signal line. Therefore, the display device of each of (a) and (b) of FIG. 9 is capable of refreshing only the region 14 including a plurality of scan signal lines corresponding to the analysis region 13. Any region other than the region 14 is driven at, for example, a low refresh rate (1 Hz).

(Image Determining Method 2)

Alternatively, the image determining section 35 can also determine the percentage of pixels, of each of a plurality of regions, which have grayscale levels falling within a predetermined range.

Figure 10:
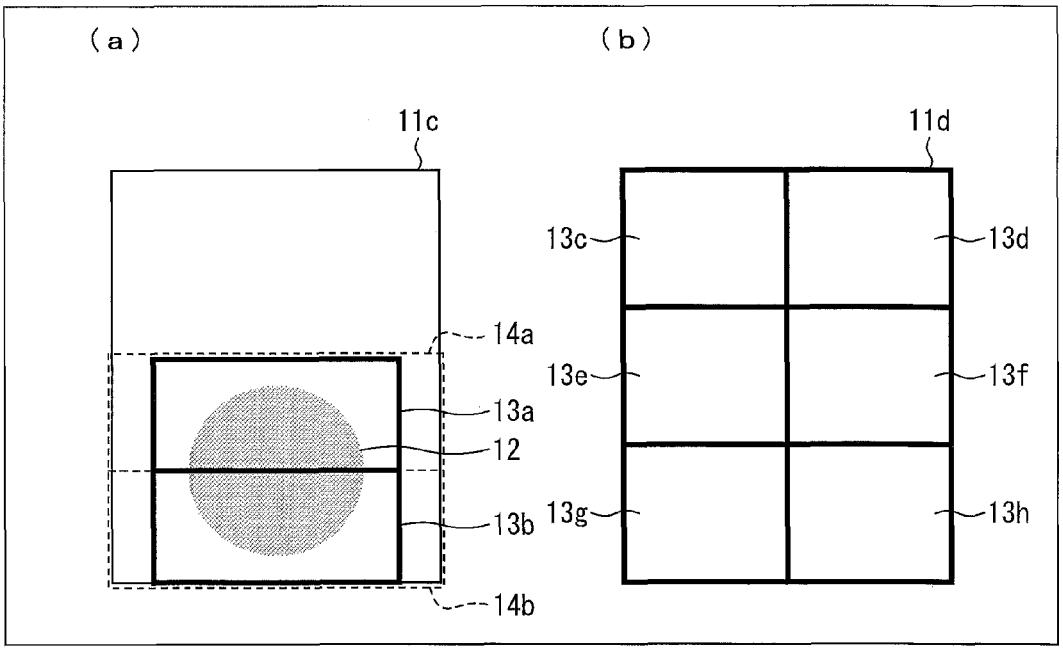
FIG. 10 is a view illustrating screens of the display device.

In an example shown in (a) of FIG. 10, a region 12, which includes pixels having non-uniform capacitances, is located across a center part to a lower part of the screen 11*c*. Therefore, an image determining section 35 sets a plurality of analysis regions 13*a* and 13*b*. Part of the region 12, which part overlaps the center part of the screen 11*c*, is included in the analysis region 13*a*. The other part of the region 12, which part overlaps the lower part of the screen 11*c*, is included in the analysis region 13*b*.

The image determining section 35 determines whether or not the percentage of pixels, of all pixels included in each of the analysis regions 13*a* and 13*b*, which have pixels having grayscale within a first range is equal to or higher than a first threshold value. In a case where it is determined that flicker easily occurs (i.e. that the percentage of the pixels having grayscale levels within the first range is equal to or higher than the first threshold value) in any one of the analysis regions 13*a* and 13*b* of the image, at least said any one of the analysis regions 13*a* and 13*b* is displayed at a high refresh rate (60 Hz). For example, in a case where the first threshold value or a higher percentage of pixels in the analysis region 13*a* have grayscale levels within the first range, the driving changing section 36 determines that a region 14*a* of the screen 11*c*, which region 14*a* includes a plurality of scan signal lines corresponding to the analysis region 13*a*, is driven at the high refresh rate (60 Hz).

For example, the region 14*a* of the screen 11*c* is assigned a refresh rate according to the grayscale levels of the plurality of pixels in the analysis region 13*a* to which the region 14*a* corresponds, whereas the region 14*b* of the screen 11*c* is assigned a refresh rate according to the grayscale levels of the plurality of pixel in the analysis region 13*b* to which the region 14*b* corresponds. Any other region of the screen 11*c* is always displayed at a refresh rate of 1 Hz if the image is a still image. Note that the driving changing section 36 can be configured to drive the entire part of the screen 11 at a high refresh rate (60 Hz) in a case where it is determined that flicker easily occurs in any one of the analysis regions.

Alternatively, as illustrated in (b) of FIG. 10, the image determining section 35 can (i) divide the entire part of the image (screen 11*d*) into a plurality of analysis regions 13*c* through 13*h* and (ii) determine whether or not a first threshold value or a higher percentage of pixels, of all pixels in each of the analysis regions, have grayscale levels falling within a first range. In such a case, the image determining section 35 generates a histogram in which pixels of each of the analysis regions are categorized into a corresponding one of classes. An analysis region 13*c* and an analysis region 13*d* are each driven by common scan signal lines. Therefore, in a case where it is determined that flicker easily occurs (i.e. that a first threshold value or a higher percentage of pixels have grayscale levels within a first range) in at least one of the analysis regions 13*c* and 13*d*, the driving changing section 36 determines that part of the screen 11*d*, which part corresponds to both the analysis region 13*c* and the analysis region 13*d*, is driven at a high refresh rate (60 Hz).

Note that the analysis regions 13*c* through 13*h* can be assigned respective conditions on which to determine the percentage. For example, the image determining section 35 can (i) determine whether or not a first threshold value or a higher percentage of pixels, of all pixels in the analysis region 13*e*, have grayscale levels within a first range and (ii) determine whether or not a second threshold value (that is different from the first threshold value) or a higher percentage of pixels, of all pixels in the analysis region 13*f*, have grayscale levels within a second range (that is different from the first range).

The percentage is thus determined according to each of the plurality of analysis regions. Therefore, even in a case of an image in which such pixels that cause flicker to easily occur are locally concentrated, it is possible to prevent recognition of flicker by properly changing a refresh rate. In addition, in a case of an image (or region) in which flicker hardly occurs, it is possible to reduce electric power consumption by displaying the image (or region) at a low refresh rate.

(Image Determining Method 3)

Alternatively, whether or not an image includes a region in which flicker easily occurs can be determined by determining whether or not the image includes a region that matches a predetermined pattern.

Figure 11:
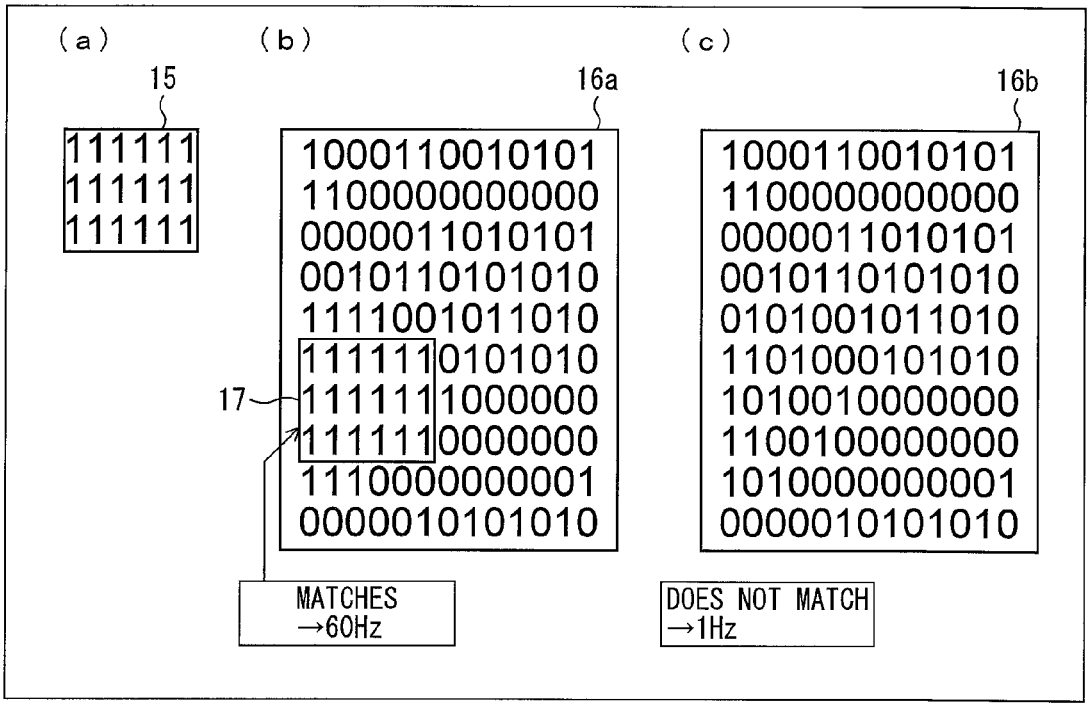
FIG. 11 is a set of views (a) through (c), (a) of FIG. 1 illustrating a predetermined pattern, and (b) and (c) of FIG. 11 each illustrating a grayscale map indicative of grayscale levels of respective pixels in an image.

(a) of FIG. 11 is a view illustrating a predetermined pattern 15. The pattern 15 is a rectangular pattern made up of 3 lines×6 rows of pixels. The number "1" indicates that a corresponding pixel has a grayscale level falling within a first range (range of grayscale level 20 to grayscale level 80). The number "0" indicates that a corresponding pixel has a grayscale level falling outside the first range. That is, the pattern 15 is a pattern made up of pixels which have grayscale levels within the first range and which are two-dimensionally arranged.

(b) and (c) of FIG. 11 are views each illustrating a grayscale map indicative of grayscale levels of respective pixels in an image. The image determining section 35 (i) determines whether or not pixels in images have grayscale levels within a first range and (ii) generates respective grayscale maps 16*a* and 16*b*. In each of the grayscale maps 16*a* and 16*b*, pixels having grayscale levels within the first range are indicated as "1", whereas pixels having grayscale levels outside the first range are indicated as "0."

As shown by the grayscale map 16*b* in (c) of FIG. 11, even in a case where a large number of pixels have grayscale levels within the first range, flicker is hardly recognizable if such pixels are sparsely dispersed. As shown by the grayscale map 16*a* in (b) of FIG. 11, in a case where a region is locally present in which pixels having grayscale levels within the first range are closely distributed, then flicker is easily recognizable even if a small percentage of pixels of the entire pixels have grayscale levels within the first range. In other words, if pixels having grayscale level within the first range are concentrated in an area that is equal to or larger than a certain region, then flicker is more easily recognizable.

The image determining section 35 determines whether or not each of the grayscale maps 16*a* and 16*b* includes a region that matches the predetermined pattern 15. The driving changing section 36 changes a refresh rate in accordance with whether or not the image includes the region matching the pattern 15.

The grayscale map 16*a* of a given image includes a region 17 that matches the pattern 15. Therefore, the image corresponding to the grayscale map 16*a* causes flicker to easily occur. Therefore, the driving changing section 36 to determines that the image is to be displayed at a high refresh rate (60 Hz). The grayscale map 16*b* of another image includes no region that matches the pattern 15. Therefore, the image corresponding to the grayscale map 16*b* causes flicker to hardly occur. Therefore, the driving changing section 36 to determines that the image is to be displayed at a low refresh rate (1 Hz).

The refresh rate is thus determined according to whether or not an image includes a region that matches the predetermined pattern 15. Therefore, recognition of flicker can be prevented by displaying, at a high refresh rate, an image (e.g. image in (b) of FIG. 11) having a local region in which flicker is easily recognizable. In addition, it is possible to reduce electric power consumption by displaying, at a low refresh rate, an image (e.g. image in (c) of FIG. 11) (i) which includes a large number of pixels having grayscale level within the first range and (ii) in which flicker is hardly recognizable.

Alternatively, the driving changing section 36 can determine that only a partial region of the image, which partial region corresponds to a region matching the predetermined pattern 15, is to be displayed at a high refresh rate. Alternatively, it is possible that, even in a case where a matching rate by which a region included in the image matches the pattern 15 is not 100%, the driving changing section 36 determines that the image is to be displayed at a high refresh rate if the matching rate is equal to or higher than a predetermined matching rate (e.g. 80%).

Note that in the above described examples, pattern matching is carried out regardless of colors of the pixels. Alternatively, it is possible to carry out pattern matching for each picture element. Specifically, the image determining section 35 can (i) generate a grayscale map indicative of whether or not luminances Y of respective picture elements fall within a predetermined range and (ii) determine whether or not a predetermined pattern constituted by the plurality of picture elements matches an image. Alternatively, the image determining section 35 can (i) generate grayscale maps corresponding to respective R, G, and B colors of a single image and (ii) determine whether or not each of the grayscale maps of the respective colors matches a predetermined pattern.

Embodiment 4

The following description will discuss another embodiment of the present invention. For convenience, members similar in function to those described in the foregoing embodiment(s) will be given the same reference signs, and their description will be omitted. According to Embodiment 4, an image determining section and a driving changing section for determining a refresh rate are provided in a substrate other than a host control section.

(Configuration of Display Device 2)

Figure 12:
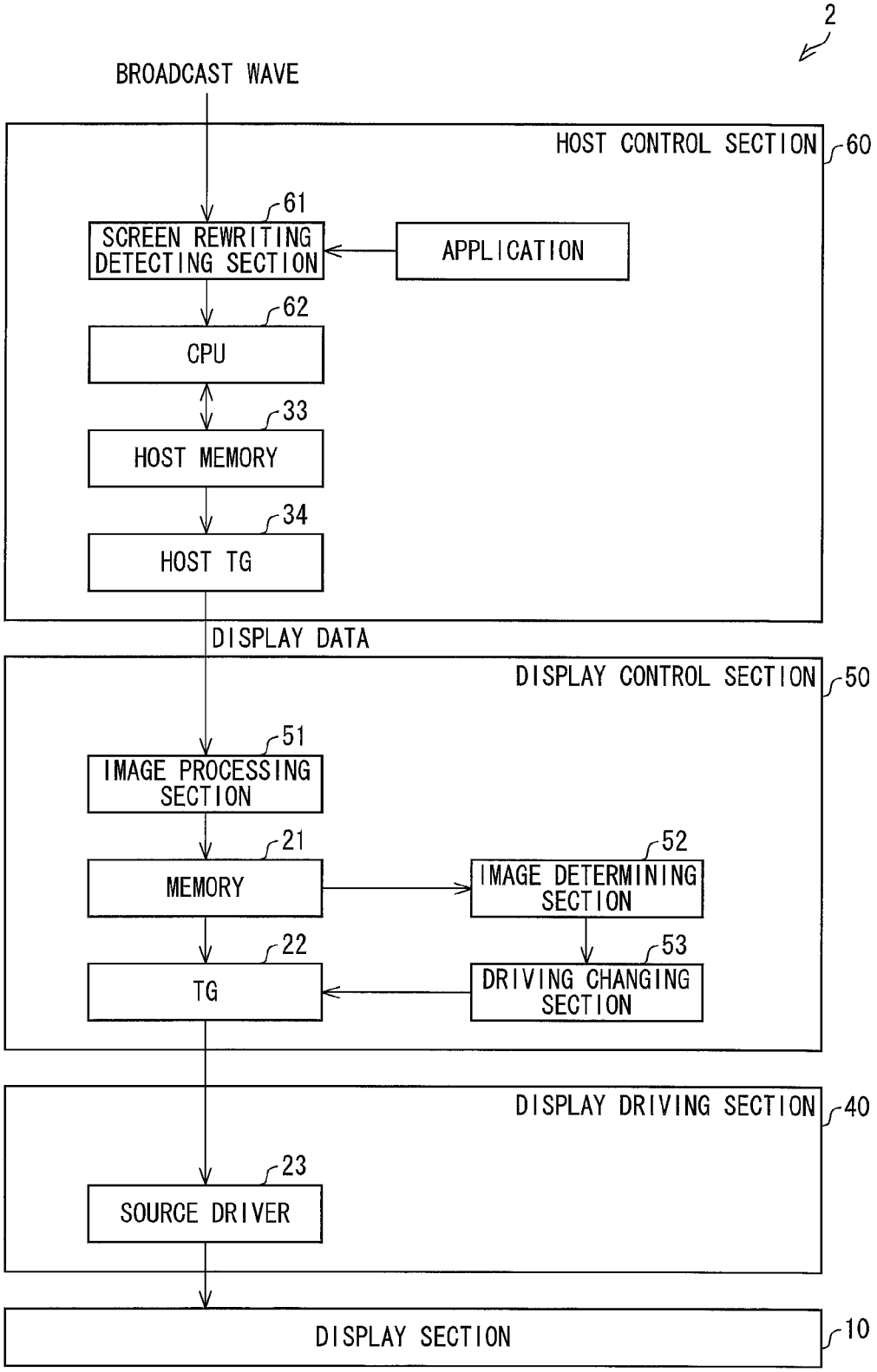
FIG. 12 is a block diagram illustrating a configuration of a display device in accordance with another aspect of the present invention.

FIG. 12 is a block diagram illustrating a configuration of a display device in accordance with Embodiment 4. A display device 2 includes a display section 10, a display driving section 40, a display control section 50 (control device), and a host control section 60.

As with Embodiment 1, the display driving section 40 is a COG driver mounted on a glass substrate of the display section 10 by use of the COG technique, and drives the display section 10. The host control section 60 is a control substrate configured by a control circuit provided on a substrate, and is a main component for controlling a host side of the display device 2. The display control section 50 is a control substrate provided apart from the host control section 60 for processing a displayed image and the like. According to Embodiment 4, it is the display control section 50 that determines a refresh rate. This allows for a reduction in load of the host control section 60, and therefore makes it possible to secure performance of the host control section 60 for carrying out a process other than displaying an image.

(Configuration of Host Control Section 60)

The host control section 60 includes a screen rewriting detection section 61, a CPU 62, a host memory 33, and a host TG 34.

The screen rewriting detection section 61 may or may not evaluate an interval between points in time at which content of an image is changed and then notify the display control section 50 of the interval. For example, The evaluation of the interval can be carried out on a display-control-section-50 side. Any other process of the screen rewriting detection section 61 is carried out as is the case of the screen rewriting detection section 31 of Embodiment 1.

The CPU 62 carries out processes similar to those carried out by the CPU 32 of Embodiment 1 except that the CPU 62 does not supply display data to an image determining section.

Only in a case where a displayed image needs to be rewritten, the host TG 34 transfers display data on the image to the display control section 50.

(Configuration of Display Control Section 50)

The display control section 50 includes an image processing section 51, an image determining section 52, a driving changing section 53, a memory 21, and a TG 22.

The image processing section 51 subjects, to image processing such as color adjustment, the display data received from the host control section 60. The image processing section 51 then writes, into the memory 21, the display data which has been subjected to the image processing.

When the display data stored in the memory 21 is rewritten, the image determining section 52 obtains the display data from the memory 21. The image determining section 52 determines whether or not an image based on the display data is an image in which flicker easily occurs. The determining process of the image determining section 52 is similar to the process described in the preceding embodiments. The image determining section 52 then supplies a determined result to the driving changing section 53. The image determining section 52 (rewriting detection section) can also (i) evaluate an interval between points in time at which content of the image is changed and (ii) supply data on the interval to the driving changing section 53.

According to the determined result of the image determining section 52, the driving changing section 53 (i) determines a refresh rate and (ii) notifies the TG 22 of the refresh rate so as to instruct that the display section 10 be driven at the refresh rate thus determined.

In accordance with the refresh rate instructed by the driving changing section 53, the TG 22 (i) reads out the display data from the memory 21 and (ii) transfers the display data to a source driver 23 of the display driving section 40. Note that the TG 22 transfers, in line with the refresh rate, the display data to the display driving section 40 regardless of whether or not an image stored in the memory 21 has been rewritten.

The display driving section 40 includes the source driver 23. A configuration of the source driver 23 is similar to that in Embodiment 1.

Embodiment 5

The following description will discuss another embodiment of the present invention. For convenience, members similar in function to those described in the foregoing embodiment(s) will be given the same reference signs, and their description will be omitted. According to Embodiment 5, an image determining section and a driving changing section for determining a refresh rate are provided in a display driving section which is a COG driver.

(Configuration Display Device 3)

Figure 13:
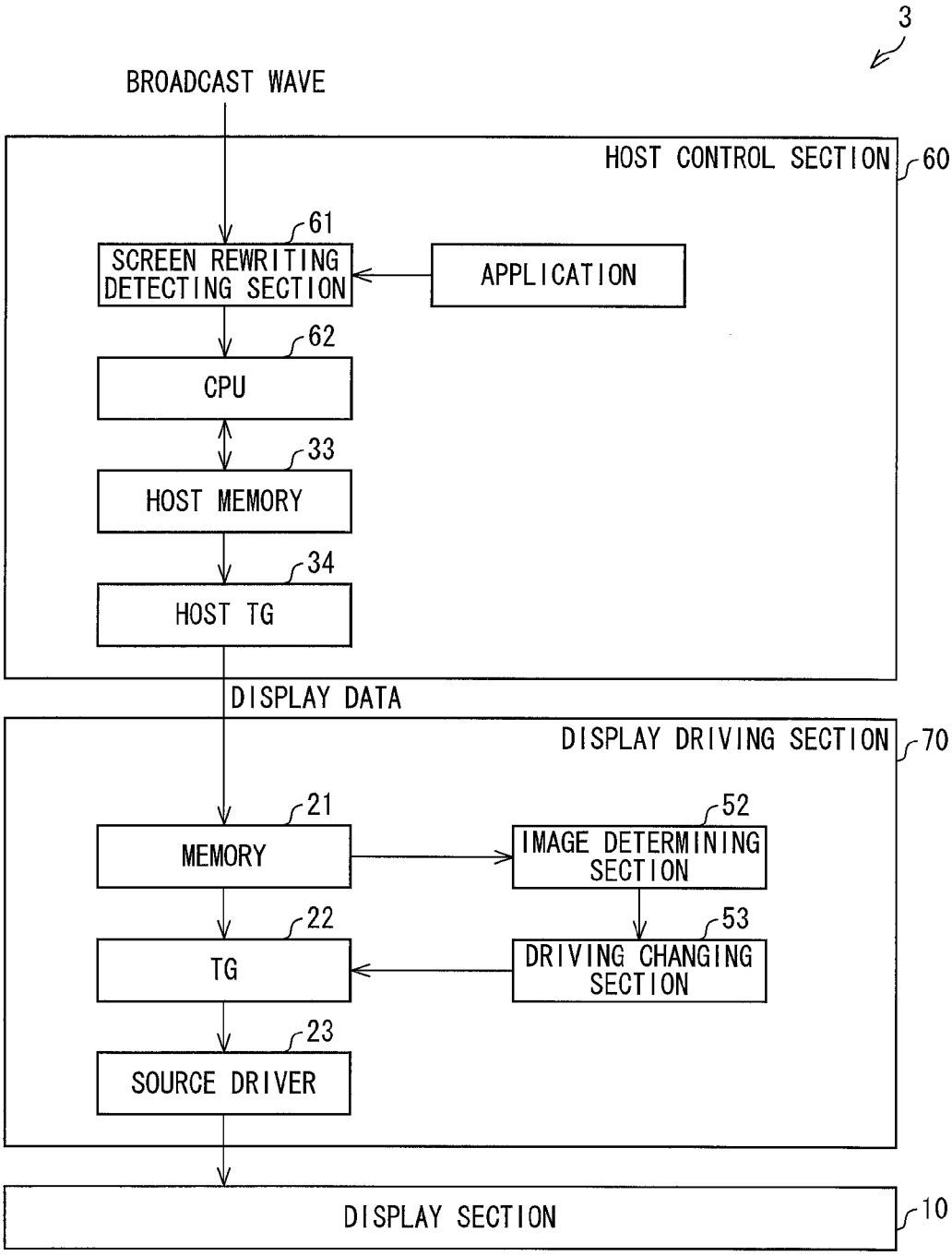
FIG. 13 is a block diagram illustrating a configuration of a display device in accordance with a further aspect of the present invention.

FIG. 13 is a block diagram illustrating a configuration of a display device in accordance with Embodiment 5. A display device 3 includes a display section 10, a display driving section 70 (control device), and a host control section 60. A configuration of the host control section 60 is similar to that in Embodiment 4. Only in a case where a displayed image needs to be rewritten, the host control section 60 transfers display data on the image to the display driving section 70.

The display driving section 70 is a COG driver mounted on a glass substrate of the display section 10 by use of the COG technique, and drives the display section 10. The display driving section 70 includes an image determining section 52, a driving changing section 53, a memory 21, a TG 22, and a source driver 23. Operations of the members includes in the display driving section 70 are similar to those described in Embodiment 4.

According to Embodiment 5, it is the COG driver (display driving section 70) that determines a refresh rate. This makes it possible to reduce a load of the host control section 60 without providing a substrate in addition to the host control section 60. Note that a surface area by which COG driver is mounted on an active matrix substrate is limited. Therefore, Embodiment 5 is suitable for a case where the image determining section 52 and the driving changing section 53 carry out a simple determining process.

SUMMARY

A control device in accordance with Aspect 1 of the present invention is a control device for a display device, said control device including: an image determining section for determining whether or not grayscale levels of a plurality of pixels in an image fall within a first range which consists of intermediate grayscale levels; and a driving changing section for changing, according to a result of the determining carried out by the image determining section, a refresh rate of the display device.

The control device in accordance with Aspect 2 of the present invention can be configured in Aspect 1 such that the image determining section determines whether or not a percentage of pixels, of all pixels in a predetermined region of the image, which have grayscale levels falling within the first range is equal to or higher than a first threshold value.

The control device in accordance with Aspect 3 of the present invention can be configured in Aspect 2 such that in a case where the percentage is lower than the first threshold value, the driving changing section determines that the image is to be displayed at a first refresh rate; and in a case where the percentage is equal to or higher than the first threshold value, the driving changing section determines that the image is to be displayed at a second refresh rate which is higher than the first refresh rate.

The control device in accordance with Aspect 4 of the present invention can be configured in Aspect 3 to further include: a screen rewriting detection section for evaluating an interval between points in time where content of the image is changed, in a case where the interval is equal to or shorter than a predetermined interval threshold value, the driving changing section determining that the image is to be displayed at a third refresh rate which is higher than the first refresh rate and which is lower than the second refresh rate, in a case where (i) the interval is longer than the interval threshold value and (ii) the percentage is lower than the first threshold value, the driving changing section determining that the image is to be displayed at the first refresh rate, and in a case where (i) the interval is longer than the interval threshold value and (ii) the percentage is equal to or higher than the first threshold value, the driving changing section determining that the image is to be displayed at the second refresh rate.

The control device in accordance with Aspect 5 of the present invention can be configured in Aspect 2 such that: where (i) a second range of grayscale levels is a range which consists of intermediate grayscale levels and which is different from the first range, (ii) a first condition is that the percentage of pixels which have grayscale levels falling within the first range is equal to or higher than the first threshold value, and (iii) a second condition is that a percentage of pixels which have grayscale levels falling within the second range is equal to or higher than a second threshold value, the driving changing section determines, in a case where the first condition is met, that the image is to be displayed at a second refresh rate; the driving changing section determines, in a case where (i) the first condition is not met and (ii) the second condition is met, that the image is to be displayed at a third refresh rate which is lower than the second refresh rate; and the driving changing section determines, in a case where (i) the first condition is not met and (ii) the second condition is not met, that the image is to displayed at a first refresh rate which is lower than the third refresh rate.

The control device in accordance with Aspect 6 of the present invention can be configured in Aspect 1 such that a single picture element includes a plurality of pixels of different colors; and the image determining section (i) determines, for each of the different colors, a percentage of pixels, of all pixels in a predetermined region of the image, which have grayscale levels falling within the first range, (ii) determines weighted values of the respective percentages, and (iii) determines a sum of the weighted values, and (iv) determines whether or not the sum is equal to or higher than a fifth threshold value.

The control device in accordance with Aspect 7 of the present invention can be configured in Aspect 1 such that a single picture element includes a plurality of pixels of different colors; and the image determining section determines a luminance of the picture element from grayscale levels of the plurality of pixels, and, in a case where the luminance of the picture element falls within a second range, determines that the grayscale levels of the plurality of pixels fall within the first range.

The r control device in accordance with Aspect 8 of the present invention can be configured in Aspect 2 such that the predetermined region is a partial region of the image; and in a case where the percentage is equal to or higher than the first threshold value, the driving changing section determines that (i) the predetermined region of the image is to be displayed at a second refresh rate and (ii) a remaining part of the image is to be displayed at a first refresh rate which is lower than the second refresh rate.

The control device in accordance with Aspect 9 of the present invention can be configured in Aspect 1 to further include: a region specifying section for specifying a first region and a second region of the image, the image determining section determining (i) whether or not a percentage of pixels, of all pixels in the first region, which have grayscale levels falling within the first range is equal to or higher than a first threshold value and (ii) whether or not a percentage of pixels, of all pixels in the second region, which have grayscale levels falling within the first range is equal to or higher than the first threshold value, in a case where the respective percentages in the first and second regions are both lower than the first threshold value, the driving changing section determining that the first region and second regions are to be displayed at a first refresh rate, and in a case where either one of the respective percentages in the first and second regions is equal to or higher than the first threshold value, the driving changing section determining that at least one of the first and second regions, which has said either one of the respective percentages, is to be displayed at a second refresh rate which is higher than the first refresh rate.

The control device in accordance with Aspect 10 of the present invention can be configured in Aspect 9 such that in a case where the percentage in the first region is lower than the first threshold value, the driving changing section determines that the first region is to be displayed at the first refresh rate; in a case where the percentage in the second region is lower than the first threshold value, the driving changing section determines that the second region is to be displayed at the first refresh rate; in a case where the percentage in the first region is equal to or higher than the first threshold value, the driving changing section determines that the first region is to be displayed at the second refresh rate; and in a case where the percentage in the second region is equal to or higher than the first threshold value, the driving changing section determines that the second region is to be displayed at the second refresh rate.

The control device in accordance with Aspect 11 of the present invention can be configured in Aspect 1 such that the image determining section determines whether or not the image includes a predetermined pattern made up of a plurality of pixels which have grayscale levels falling within the first range; in a case where the image does not include the predetermined pattern, the driving changing section determines that the image is to be displayed at a first refresh rate; and in a case where the image includes the predetermined pattern, the driving changing section determines that the image is to be displayed at a second refresh rate which is higher than the first refresh rate.

A display device in accordance with Aspect 12 of the present invention includes the control device in accordance with any one of Aspects 1 through 11.

The display device in accordance with Aspect 13 of the present invention can be configured such that an oxide semiconductor is used for a semiconductor layer of a TFT (thin film transistor) included in a pixel of the display device.

A control method in accordance with Aspect 14 of the present invention is a method of controlling a display device, including the steps of: (a) determining whether or not grayscale levels of a plurality of pixels in an image fall within a first range which consists of intermediate grayscale levels; and (b) changing, according to a result of the determining carried out in the step (a), a refresh rate of the display device.

The present invention is not limited to the description of the embodiments, but can be altered in many ways by a person skilled in the art within the scope of the claims. An embodiment derived from a proper combination of technical means disclosed in different embodiments is also encompassed in the technical scope of the present invention. Furthermore, a new technical feature can be obtained by a combination of technical means disclosed in the different embodiments.

INDUSTRIAL APPLICABILITY

The present invention is applicable to display devices.

REFERENCE SIGNS LIST

1, 2, 3 Display device
10 Display section
11*a* through 11*d* Screen
13, 13*a* through 13*h* Analysis region
15 Pattern
16*a*, 16*b* Grayscale map
20, 40, 70 Display driving section (control device)
30, 60 Host control section (control device)
31, 61 Screen rewriting detection section (rewriting detection section)
35, 52 Image determining section (region specifying section)
36, 53 Driving changing section
50 Display control section (control device)
51 Image processing section

The invention claimed is:

1. A control device for a display device,
said control device comprising:
an image determining section for determining whether or not grayscale levels of a plurality of pixels in an image fall within a first range which consists of intermediate grayscale levels;
a driving changing section for changing, according to a result of the determining carried out by the image determining section, a refresh rate of the display device; and
a rewriting detection section for evaluating an interval between points in time where content of the image is changed, wherein
the image determining section determines whether or not a percentage of pixels, of all pixels in a predetermined region of the image, which have grayscale levels falling within the first range is equal to or higher than a first threshold value,
in a case where the percentage is lower than the first threshold value, the driving changing section determines that the image is to be displayed at a first refresh rate,
in a case where the percentage is equal to or higher than the first threshold value, the driving changing section determines that the image is to be displayed at a second refresh rate which is higher than the first refresh rate,
in a case where the interval is equal to or shorter than a predetermined interval threshold value, the driving changing section determining that the image is to be displayed at a third refresh rate which is higher than the first refresh rate and which is lower than the second refresh rate,
in a case where (i) the interval is longer than the interval threshold value and (ii) the percentage is lower than the first threshold value, the driving changing section determining that the image is to be displayed at the first refresh rate, and
in a case where (i) the interval is longer than the interval threshold value and (ii) the percentage is equal to or higher than the first threshold value, the driving changing section determining that the image is to be displayed at the second refresh rate.

2. A display device comprising: a control device recited in claim 1.

3. A control device for a display device,
said control device comprising:
an image determining section for determining whether or not grayscale levels of a plurality of pixels in an image fall within a first range which consists of intermediate grayscale levels; and
a driving changing section for changing, according to a result of the determining carried out by the image determining section, a refresh rate of the display device; wherein the image determining section determines whether or not a percentage of pixels, of all pixels in a predetermined region of the image, which have grayscale levels falling within the first range is equal to or higher than a first threshold value;

where (i) a second range of grayscale levels is a range which consists of intermediate grayscale levels and which is different from the first range, (ii) a first condition is that the percentage of pixels which have grayscale levels falling within the first range is equal to or higher than the first threshold value, and (iii) a second condition is that a percentage of pixels which have grayscale levels falling within the second range is equal to or higher than a second threshold value, the driving changing section determines, in a case where the first condition is met, that the image is to be displayed at a second refresh rate;

the driving changing section determines, in a case where (i) the first condition is not met and (ii) the second condition is met, that the image is to be displayed at a third refresh rate which is lower than the second refresh rate; and the driving changing section determines, in a case where (i) the first condition is not met and (ii) the second condition is not met, that the image is to displayed at a first refresh rate which is lower than the third refresh rate.

4. A display device comprising: a control device recited in claim 3.

5. A control device for a display device, said control device comprising:

an image determining section for determining whether or not grayscale levels of a plurality of pixels in an image fall within a first range which consists of intermediate grayscale levels; and a driving changing section for changing, according to a result of the determining carried out by the image determining section, a refresh rate of the display device; wherein a single picture element includes a plurality of pixels of different colors; and the image determining section (i) determines, for each of the different colors, a percentage of pixels, of all pixels in a predetermined region of the image, which have grayscale levels falling within the first range, (ii) determines weighted values of the respective percentages, and (iii) determines a sum of the weighted values, and (iv) determines whether or not the sum is equal to or higher than a fifth threshold value.

6. A display device comprising: a control device recited in claim 5.

7. A control device for a display device, said control device comprising:

an image determining section for determining whether or not grayscale levels of a plurality of pixels in an image fall within a first range which consists of intermediate grayscale levels; and a driving changing section for changing, according to a result of the determining carried out by the image determining section, a refresh rate of the display device; wherein a single picture element includes a plurality of pixels of different colors; and the image determining section determines a luminance of the picture element from grayscale levels of the plurality of pixels, and, in a case where the luminance of the picture element falls within a second range, determines that the grayscale levels of the plurality of pixels fall within the first range.

8. A display device comprising: a control device recited in claim 7.

* * * * *